United States Patent [19]

Metcalf

[11] Patent Number: 4,832,298

[45] Date of Patent: May 23, 1989

[54] DISPLAY HOOK STRUCTURE

[75] Inventor: Derek N. G. Metcalf, La Grange, Ill.

[73] Assignee: Athena Industries, Inc., LaGrange, Ill.

[21] Appl. No.: 203,339

[22] Filed: May 31, 1988

[51] Int. Cl.[4] ..... A47F 5/00

[52] U.S. Cl. ..... 248/222.2; 248/225.2; 211/59.1

[58] Field of Search ..... 248/124, 214, 215, 220.2, 248/222.2, 222.3, 225.2, 298; 211/54.1, 57.1, 59.1, 181, 94

[56] References Cited

U.S. PATENT DOCUMENTS

| | | | |
|---|---|---|---|
| 2,291,966 | 8/1942 | Joseph | 248/298 |
| 3,853,293 | 12/1974 | Larson | 248/221.1 |
| 3,926,395 | 12/1975 | Lallement | 248/222.2 |
| 4,018,341 | 4/1977 | Jarecki | 211/59.1 |
| 4,340,144 | 7/1982 | Cousins | 248/222.2 |
| 4,452,360 | 6/1984 | Barnes | 248/222.2 |
| 4,474,351 | 10/1984 | Thalenfeld | 248/222.2 |
| 4,509,648 | 4/1985 | Govang | 248/220.2 |
| 4,593,624 | 6/1986 | Pfeifer | 211/57.1 |
| 4,618,192 | 10/1986 | Kelley | 248/225.2 |
| 4,688,683 | 8/1987 | Thalenfeld | 248/222.2 |

*Primary Examiner*—J. Franklin Foss
*Assistant Examiner*—Robert A. Olson
*Attorney, Agent, or Firm*—McCaleb, Lucas & Brugman

[57] ABSTRACT

An improved hook structure for use with crossbar grid merchandise display systems capable of snap-fit engagement with pairs of adjacent horizontal grid crossbars or wires at selected lateral positions; the hook structures being slidable along the crossbars and characterized by a narrow dimensioned hook section composed of a sandwich assembly of two identical parallel metal hook plates disposed on opposite sides of and integrated with an interposed base end of a wire display rod. The metal sandwich structure so formed, permits interlocking back-to-back application of a pair of hook structures when sharing the same pair of grid crossbars. The narrow dimensioning and sandwich structure of the hook section permits placement of the hook structures closely against or over an upright or vertical member of the grid system for more efficient use of the supporting grid area as well as the placement of two or more hook structures in contacting adjacency for purposes of supporting heavier objects on two or more extending merchandise display rods thereof.

9 Claims, 1 Drawing Sheet

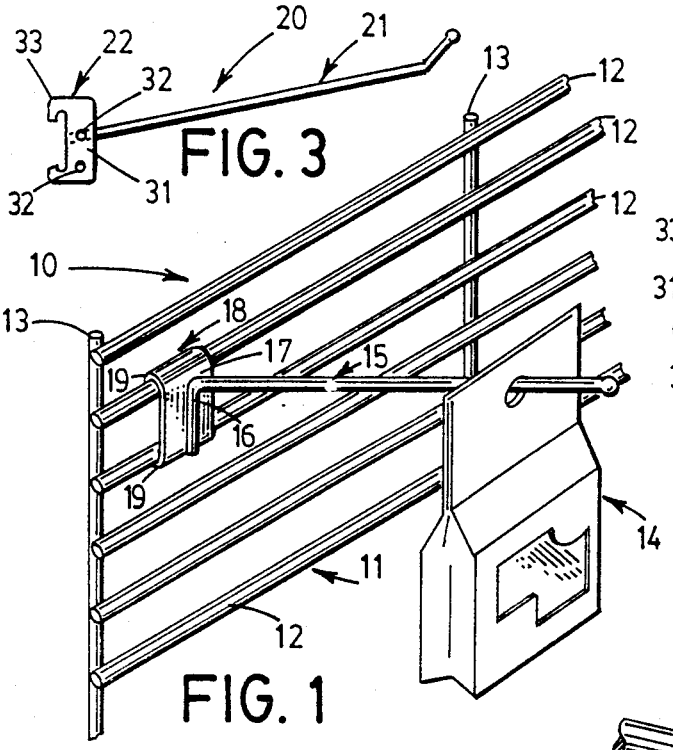
FIG. 3
FIG. 1
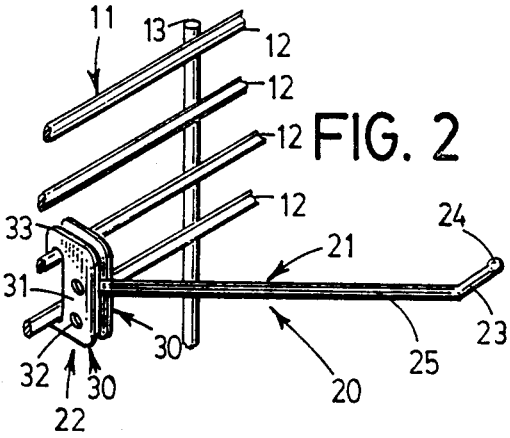
FIG. 2
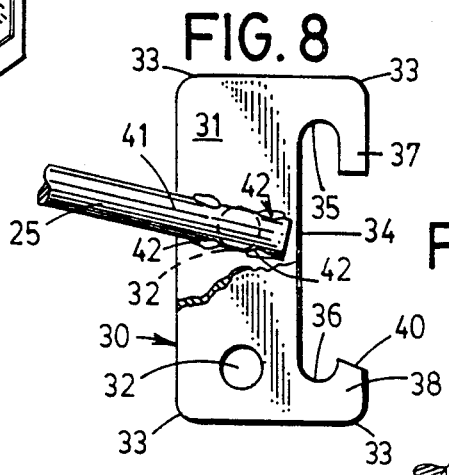
FIG. 8
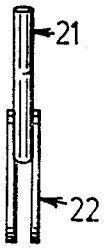
FIG. 6
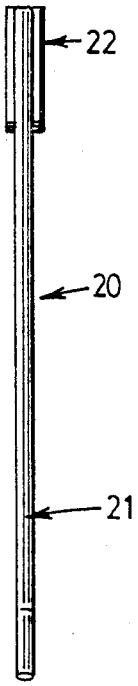
FIG. 4
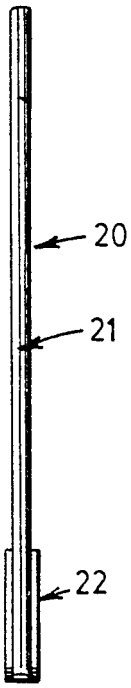
FIG. 5
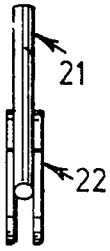
FIG. 7
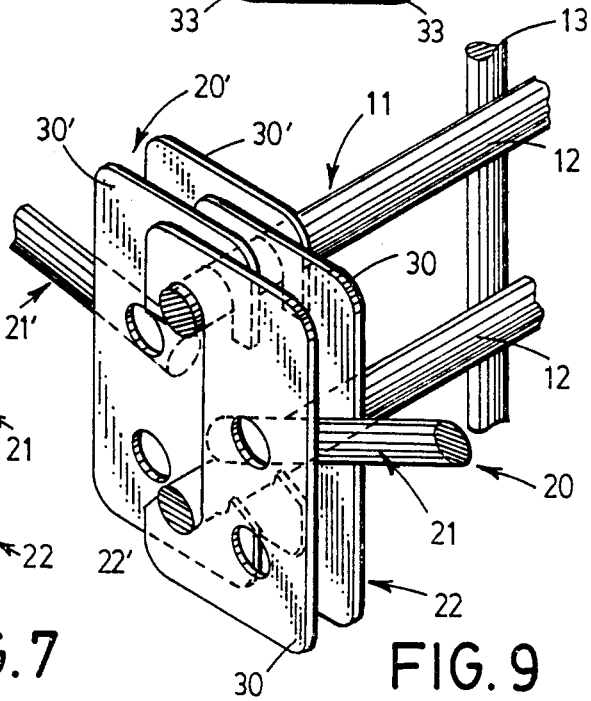
FIG. 9

DISPLAY HOOK STRUCTURE

This invention pertains generally to grid merchandise display systems and more particularly to improvements in display hooks used therewith.

BACKGROUND OF THE INVENTION

Grid display systems composed of a rack or grid made up of plural co-planar horizontal crossbars or wire rods interjoined by relatively widely spaced vertical support rods and a plurality of display hooks which may be fastened to the crossbars for purposes of displaying merchandise are well known and a familiar part of the merchandise display art. The general advantage of a merchandise display system of this order is the provision of a very flexible system where the display hooks may be placed in an infinite variety of positions and spaced at selected lateral and vertical intervals to accommodate various sized products being displayed. Usually the merchandise to be displayed is packaged and the hooks include an extending elongated support or display rod insertable through an eyelet formed in the packaging. Each support rod can support one or more packages so that the system provides a convenient way of not only displaying the packaged merchandise, but storing a ready supply which is important for self service merchandizing. In the past typical display hook structures have included a hook section made of a formed metal plate secured to the base end of an extending merchandise display rod; the hook section being of relatively wide or lateral dimension and having a substantially U-shaped configuration so that it is capable of fitting over a pair of adjacent parallel horizontal crossbar wires. The display rod portion of the hook structure is normally a formed wire rod having a base end portion secured, as by welding or the like, to the plate or body of the hook section. Because of the relatively wide dimension of the hook section, placing two or more hook structures alongside of one another so that the extending merchandise display rod portions thereof may accommodate heavy or bulky merchandise packages is not readily feasible. In addition because of the relatively extended lateral dimension of the hook section, the positioning of the known hook structures in alignment with or so that the display rod is next to a vertical support wire of the grid network is not possible, thus wasting valuable lateral space of the support grid.

The above and further problems and drawbacks of the prior art are satisfactorily resolved by the present invention which presents marked improvements over hook structures heretofore known in the art.

In brief, the present invention comprises an improved hook structure for use in grid or crossbar merchandise display systems which is composed of a simplified hook section made up of two identical stamped metal plates posed in side by side parallelism on opposite sides of an intervening base end of a display rod; the plates and display rod being integrated, as by welding, into a rigid sandwich of relatively narrow dimensions. The stamped parts are formed with appropriate hook fingers capable of snap fit engagement with a pair of adjacent horizontally parallel crossbars of the support grid. Because of the simplicity of the structure, the provision of the two identically stamped parts provides a far more economical, fast and precise method of presenting a hook capable of snap-fit engagement with the grid members and further permits the use of a straight or non-formed end of a wire display rod to be entrapped and welded between the stamped plates, as opposed to preforming one end of a wire display rod prior to its connection to a conventional planar back plate of the hook section in accordance with past practice. Because of the narrow dimensioning of the hook section in accordance with the structure of this invention, two or more hook structures may be placed in contacting adjacency to support heavy packages thereon. Since the two plates or stamped metal parts of each hook section are in parallel spaced relationship, the same may receive on upright support of the display grid therebetween or be placed in back-to-back interleaved relationship and engaged at the same location with the same pair of wire rods of the supporting grid to materially increase display capacity of the system.

It is a principle object of this invention to provide an improved hook structure for utilization with crossbar or grid display systems which exhibits an improved versatility of use and economy of available display space.

Another important object of this invention is to provide an improved display hook structure for use with grid display systems which lends itself to improved and simplified manufacture and assembly procedures leading to economies of production.

A still further important object of this invention is to provide an improved display hook structure of the order set out in the preceeding two objectives which is capable of back-to-back display use so that two hook structures may share the same pair of wire crossbars of the grid display network in substantially the same location.

Another important object of this invention is to provide a grid display hook structure having a very narrow overall lateral dimension which facilitates more efficient utilization of available lateral display space provided by the supporting grid network.

Having described this invention, the above and further objects, features and advantages thereof will appear from time to time in the following detailed description of a preferred embodiment thereof, illustrated in the accompanying drawings and representing the best mode presently contemplated for enabling those of skill in the art to practice this invention.

IN THE DRAWINGS

FIG. 1 is a partial perspective view of a typical prior art grid d system of the order to which this invention is directed;

FIG. 2 is a partial perspective view of an improved display hook structure in accordance with this invention showing the same mounted on a display grid;

FIG. 3 is a side elevation of the hook structure shown in FIG. 2;

FIG. 4 is a top plan view thereof;

FIG. 5 is a bottom plan view thereof;

FIG. 6 is a front end elevation thereof;

FIG. 7 is a rear end elevation thereof;

FIG. 8 is an enlarged partial side elevation of the base or hook section of the hook structure shown in FIGS. 3–7; and FIG. 9 is a partial perspective view illustrating a pair of hook structures, as illustrated in FIGS. 2–8, disposed in back-to-back interleaved adjacency and engaged with the same pair of grid cross wires.

DESCRIPTION OF THE PREFERRED EMBODIMENT

With initial reference to FIG. 1 of the drawings, a typical prior art grid display system 10 illustrated therein comprises a support grid structure, indicated generally by 11, composed of a plurality of co-planar horizontal wire crossbars or rail members 12, 12 disposed in spaced parallelism and interconnected by relatively widely laterally spaced vertical support rods 13, 13; it being understood that the partial support grid 11 illustrated may vary in size vertically and laterally in accordance with the requirements of the display. Usually the horizontal wire rods 12 are welded at their lateral ends to spaced uprights and likewise joined by one or more vertical upright members 13 intermediate their ends to provide rigidity to the structure and limit flexure of the wire rod members 12. A typical display package 14 is supported on a extending display rod 15 which has an upset outer end and a downwardly bent base end portion 16 welded centrally to a planar base plate 17 of the hook section, indicated generally at 18. The base plate 17 is formed with a pair of reentrantly turned hook members 19, 19, which are vertically spaced to snap over a pair of the horizontal crossbar members 12, 12, as shown.

With reference to FIGS. 2 and 3 of the drawings, it will be understood that the improved hook structure according to this invention, indicated generally by numeral 20, comprises an elongated merchandise support rod 21 having a base or hook section 22.

The merchandise support rod 21 comprises a length of heavy metal wire or rod, typically having a diameter of approximately ⅛", which is bent adjacent its outer end thereof to provide an upstanding finger portion 23 having an upset or bulbous outer end 24. Portion 23 is integral with a linear shank portion 25 of selected length, typically in the order of 6–9".

The hook section 22 comprises a pair of identical stamped metal hook plates 30, 30 comprising a rectangular planar body portion 31 having one or more vertically spaced openings 32, 32 therethrough for purposes which will appear presently. All four corners of the rectangular body portion 31 are suitably radiused or rounded as at 33. (See FIG. 8).

As best seen in FIGS. 3 and 8 of the drawings the operationally rearward or trailing edge of each of the plates 30 is stamped out to form a vacancy comprising an elongated vertical channel opening bounded on one side by a linear edge 34 and at its upper and lower ends or by opposing curvelinear detent portions 35 and 36, respectively. The channel cut-out is open along the rearward edge of the plate body 31 and is partially closed at its upper end by a depending locking finger portion 37 and a shorter upstanding locking finger portion 38 adjacent its lower end. The latter locking finger portion 38 is distinguished by an upwardly sloping surface 40 disposed at substantially 20° to the horizontal which acts as a cam surface to assist mounting the hook section 22 of structure 21 over a pair of adjacent crossbar members 12, 12, as shown in FIG. 2.

It will be recognized from FIG. 8 in particular, that the width or front-to-back dimension of the elongated cut-out of each hook plate 30 is sufficient to accommodate the diameter of the horizontal rods or wires 12 of the supporting grid with some clearance. Thus when the hook section 22 of the hook structure is mounted over a pair of the wire rods 12, 12, the uppermost rod will engage the curvilinear detent portions 35 of the pair of hook plates while the lowermost of the pair of engaged rods will snap into the lower detent portions 36 thereof.

In order to integrate the two plates 30, 30 with the support rod 21 to formulate the hook structure 20, the two plates are disposed in superposed registration between a pair of planar welding electrodes with the base end portion 41 of the merchandise support rod 27 located therebetween at a desired angle and opposite a pair of the openings 32, 32, as best shown in FIG. 8 of the drawings. By thusly disposing the plates and support rod in a welding machine, the plate members 30, 30 are held in parallel spaced sandwich relationship with the shank 25 therebetween; the latter being located so that the base portion 41 thereof extends substantially across the plate body 31 to closely approach the edge portion 34 of the rear cut-out area. The presence of the openings 32 serves to concentrate the electrical welding energy to effectuate appropriate welded connection 42 between rod portion 41 and the inner faces of the opposed plates 30, 30 as indicated in FIG. 8. In some instances the lowermost openings 32 are employed to formulate a hook structure in which the merchandise support rod extends from near the lowermost edge of the hook plates as desired.

USE AND OPERATION

With the hook plates 30, 30 and interposed rod portion 41 integrated in a sandwich structure as above described, it will be recognized particularly from FIGS. 4–7 as well as FIG. 9 that the overall lateral dimension of the hook structure 20 is relatively narrow and just slightly wider than the diameter of the support rod 25. Mounting or interconnection of the hook section 22 with a pair of the grid crossbars 12, 12 as indicated in FIG. 2 of the drawings, is accomplished by hooking the upper finger portions 37, 37 of the pair of hook plates over the uppermost crossbar 12 and pivoting the merchandise support rod 21 downwardly to cause the lowermost crossbar 12 to ride up over cam surface 40 of the lower hook portion 38, flexing the lower rod upwardly until it clears the cam surface 40 and snaps downwardly into curvelinear detent portion 36. To dismount the hook structure 20 from the rails 12, 12 reverse pivotal activity or upward pushing movement on the support rod 25 is usually sufficient to flex the lowermost rail upwardly enough to clear the lower hook portion 38 and if not, as may occur when closely adjacent one of the vertical support rods 13 for example, light upward manual flexing of the lower engaged rail or rod 12 will effectuate the desired disengagement thereof from the hook portion 38. Thereafter upward lifting of the hook structure 20 will remove the hook portions 37 from the uppermost engaged crossbar 12.

It will be recalled that one of the features of this invention resides in the ability to dispose a pair of hook structures 20 in back-to-back relation on the same pair of rails or crossbars so as to maximize the utilization of display area presented by the support grid 11. This condition is illustrated specifically in FIG. 9 of the drawings from whence it will be recognized that plate members 30, 30 of the foremost hook structure 20, there illustrated, are secured over two crossbars 12, 12. Corresponding hook plates 30′, 30′ of the secondary hook structure 20′ of that figure, are disposed in overlapping interleaved relationship with the plates 30, 30 and likewise are engaged with the same pair of crossbars. So mounted the two hook structures 20 position the merchandise display rods 21, 21' thereof in oppositely extending directions from the same pair of grid support crossbars and at substantially the same location thereon.

It also will be appreciated that due to the very narrow lateral dimension of the hook section 22, the spacing between adjacent vertical supports 13 of the grid support may be utilized to a maximum to accommodate the mounting thereon of a greater number of hook structures 20 than is capable of being accomplished by the conventional hook structure 15 illustrated in FIG. 1 of the drawings. In this latter regard, the narrow hook section 22 may be positioned to closely approach and engage the vertical support rails 13, 13 of the grid support system contrary to the capabilities of the relatively wide base member 17 of the conventional prior hook structure 15, as illustrated. If desired, the spaced plates of the hook section may fit over and receive a vertical rail 13 therebetween to promote even greater use of the lateral dimensions of the grid support.

From the foregoing it is believed that those familiar with the art will readily recognize and appreciate the advancement presented by the present invention, both as to the simplicity of manufacture and assembly and its improved features of operation. Further it is believed that those with skill in the art will understand that while the present invention has been described in association with a particular preferred embodiment illustrated in the drawings, the same is susceptible to modification, variation and substitution of equivalents without departing from the spirit and scope of the invention, which is intended to be unlimited by the foregoing description except as may appear in the following appended claims.

The embodiments of the invention in which an exclusive property or privilege is claimed are defined as follows:

1. A merchandise display hook structure for use in crossbar grid merchandise display systems characterized by a support grid composed of plural, co-planar, horizontal, spaced crossbars fixed to laterally spaced vertical supports, comprising: an elongated merchandise support rod, and an operationally vertical hook assembly at one end of said rod, comprising a pair of identical, planar, registeringly opposed, parallel, metal, hook plates integrally joined to opposite sides of said rod, and spaced hook means formed within the boundaries of each of said plates for slidably coupling the display hook structure to a pair of adjacent horizontal cross bars of the grid.

2. A display hook structure for use in a cross bar grid merchandise display system characterized by a support grid composed of a plurality of co-planar, spaced horizontal crossbars fixed to laterally spaced vertical supports, comprising: a generally linear elongated merchandise support rod, and a narrow width hook section fixed to one end of said rod comprising, a pair of identical, planar, laterally spaced, vertical hook plates, each formed with integral hook means within the boundaries thereof and adapted to be connected to a pair of said cross bars, and means integrally connecting said plates in parallel registration to and along opposite sides of said rod so that said hook means are positioned to engage a pair of said cross bars.

3. The display hook structure of claim 2 wherein said plates are formed to provide cooperating pairs of vertically spaced laterally opposing locking fingers adapted to capture a pair of adjacent horizontal crossbars therebetween when said hook structure is mounted to said support grid.

4. The display hook structure of claim 3, wherein each of said hook plates comprises a substantially planar quadrangular body, said locking fingers being formed within the boundaries of and along one edge of said body in opposing relationship, and cooperating detent means formed adjacently between said fingers and said body for lockingly receiving said crossbars.

5. The display hook structure of claim 3, wherein said locking fingers are vertically spaced along an operationally rearward edge of said plates with one of said fingers thereof having an angularly disposed camming surface adapted to flex one of a pair of adjacent said crossbars upwardly thereover in response to pivotal movement of the hook structure about the other of said fingers when engaging said pair of crossbars.

6. The display hook structure of claim 2, wherein said plates and support rod are metal and said means for connecting said plates to said rod are welded connections.

7. The hook structure of claim 2, wherein said hook plates are identical stamped metal parts.

8. The display hook structure of claim 2, wherein said support rod serves to laterally space said plates and the thickness of each plate is less than the spacing between said plates whereby two of said hook structures are adapted to be mounted in back-to-back opposing relationship on opposite sides of the same pair of crossbars and at substantially the same location thereon; the plates of said hook structures lying in overlapping, interleaved relation.

9. The display hook structure of claim 2, wherein said plates are laterally spaced to permit a vertical support of the grid system to be received closely therebetween.

* * * * *